US011566440B2

(12) United States Patent
Chen

(10) Patent No.: US 11,566,440 B2
(45) Date of Patent: Jan. 31, 2023

(54) LOCK

(71) Applicant: Jeff Chen, Chiayi County (TW)

(72) Inventor: Jeff Chen, Chiayi County (TW)

( * ) Notice: Subject to any disclaimer, the term of this patent is extended or adjusted under 35 U.S.C. 154(b) by 242 days.

(21) Appl. No.: 17/008,649

(22) Filed: Sep. 1, 2020

(65) Prior Publication Data

US 2022/0064989 A1 Mar. 3, 2022

(51) Int. Cl.
*E05B 3/06* (2006.01)
*E05B 15/00* (2006.01)

(52) U.S. Cl.
CPC ..... *E05B 3/065* (2013.01); *E05B 15/0033* (2013.01); *E05Y 2900/132* (2013.01)

(58) Field of Classification Search
CPC ... E05B 3/00; E05B 3/065; E05B 3/04; E05B 3/06; E05B 15/00; E05B 15/0033; E05B 15/0006; E05B 15/065; E05B 15/101; E05B 15/143; E05Y 2900/00; E05Y 2900/132
USPC ..... 292/336.3
See application file for complete search history.

(56) References Cited

U.S. PATENT DOCUMENTS 6,807,833 B1 * 10/2004 Huang ..... E05B 13/101 70/217
6,993,945 B1 * 2/2006 Chen ..... E05B 13/101 70/222
7,559,219 B2 * 7/2009 Chen ..... E05B 65/1086 292/336.3
7,934,754 B2 * 5/2011 Mathachan ..... E05B 13/002 292/336.5
8,491,023 B2 * 7/2013 Brannaman ..... E05B 13/002 292/336.5

* cited by examiner

*Primary Examiner* — Nathan Cumar
(74) *Attorney, Agent, or Firm* — Raymond Chan

(57) ABSTRACT

A lock includes a latch assembly, a first locking mechanism, a second locking mechanism, a linkage mechanism, a clutch mechanism, and a rebounding mechanism. The lock utilizes a first clutch member and a second clutch member of the clutch mechanism to coordinate with a leaning portion of an inner linkage member of the linkage mechanism to achieve that when the turned inner linkage member will outward push the first clutch member and the second clutch member away from each other to make the second clutch member rapidly and accurately be engaged with an outer linkage member of the linkage mechanism so as to make the outer linkage member to drive the latch assembly to unlock. The arrangement provided by the present invention that has the first clutch member and the second clutch member coordinate with the leaning portion of the inner linkage member simplifies the entire structure of the lock.

4 Claims, 7 Drawing Sheets

LOCK

BACKGROUND OF THE PRESENT INVENTION

Field of Invention

The present invention relates to a lock, and in particular, to a lock that utilizes the clutching relations between two elements to serve the purposes of locking and unlocking.

Description of Related Arts

It is notable that there are locks of numerous types in the market, such as Taiwan Patent No. 96204815, 93220725, and 100221244 and U.S. patent Ser. Nos. 13/414,796 and 13/559,949 and the like. The disclosed structures of the locks are often utilized for regular household door locks, which allow the user to lock or unlock through using a key from the outside of the door or turning a knob from inside of the door. Based on the disclosure of the above prior cases, the structural arrangements of locks are diversified. However, the present invention further provides another relatively structurally simplified lock with a different construct, so as to provide another choice for the consumers.

SUMMARY OF THE PRESENT INVENTION

Hence, an object of the present invention is to provide a lock with a simpler structure.

Accordingly, the present invention provides a lock adapted for being assembled on a door sheet, wherein the door sheet has a first surface, a second surface, a lateral margin, as well as an assembling hole passing through the first surface and the second surface, wherein the lock comprises a latch assembly, a first locking mechanism, a second locking mechanism, a linkage mechanism, a clutch mechanism, and a rebounding mechanism. The latch assembly is adapted for being assembled on the lateral margin of the door sheet and extended into the assembling hole, and comprises an assembly body and a latch linkably arranged with the assembly body, wherein the assembly body has a core lock hole formed at the position thereon corresponding to the assembling hole. The first locking mechanism is adapted for being assembled in the assembling hole from the first surface of the door sheet, and comprises a veneer, adapted for being assembled on the first surface, an outside handle pivotally arranged on the veneer, a lock core assembled on the outside handle, and a shaft tube connected with the outside handle and axially aligned to the lock core, wherein the shaft tube has a guide slot axially arranged thereon. The second locking mechanism is adapted for being assembled on the second surface of the door sheet, and comprises an inside handle and an anti-lock knob arranged on the inside handle, wherein the inside handle has a connecting hole arranged thereon. The linkage mechanism is linkingly arranged among the lock core, the anti-lock knob, and the outside handle, and comprises an inner linkage member and an outer linkage member, wherein the two ends of the inner linkage member are respectively connected with the lock core and the anti-lock knob, wherein the inner linkage member has two leaning portions protruded at the end thereof close to the lock core, wherein the section of the outer linkage member is in a non-circular tubular shape, which is sleeved on the outer side of the inner linkage member and passes through the core lock hole, wherein the outer linkage member has a buckling portion arranged at an end thereof, wherein the other end thereof is inserted into the connecting hole, wherein the buckling portion has an indentation arranged on two sides thereof respectively. The clutch mechanism is sleeved on the inner linkage member, wherein the clutch mechanism comprises a first clutch member, a second clutch member, and two resilient members, wherein the first clutch member and the second clutch member are positioned in the shaft tube and respectively arranged on the two side of the leaning portion and have a first guiding key and a second guiding key respectively arranged on the upper portions thereof to be coupled with the guide slot of the shaft tube, so as to allow the first clutch member and the second clutch member to axially move relatively to the shaft tube, wherein the end faces of the first clutch member and the second clutch member facing each other respectively have a first bulging portion and a second bulging portion corresponding to each other in an up and down manner and a first recess portion and a second recess portion positioned in the middle portion thereof, wherein the second clutch member further has an engaging rib protruded on each of the two sides thereof to correspondingly engage into the indentations of the buckling portion, wherein the first bulging portion and the second bulging portion lean with each other, wherein the first recess portion and the second recess portion jointly define a accommodation space for accommodating the leaning portions, wherein the resilient members are respectively arranged between the shaft tube and the first clutch member to push thereagainst and between the second clutch member and the buckling portion to push thereagainst, rendering the first clutch member and the second clutch member leaning against each other. The rebounding mechanism is assembled between the veneer and the shaft tube, such that when the outside handle drives the shaft tube to rotate, the rebounding mechanism accumulates resilience, so that when the external force acting on the outside handle disappears, the accumulated resilience will drive the shaft tube and the outside handle to restore.

When unlocking the lock, one may operate the lock core or the anti-lock knob to bring the inner linkage member to turn, so as to shift the leaning portion to the middle of the first bulging portion and the second bulging portion in order to push the first clutch member and the second clutch member to move apart. At this moment, the engaging rib of the second clutch member is engaged in the indentation of the buckling portion, which then drives the outer linkage member to turn, in order to drive the assembly body to link the latch to unlock. The lock of the present invention utilizes the arrangement that has the first clutch member and the second clutch member of the clutch mechanism to coordinate with the leaning portion of the inner linkage member to rapidly and accurately engage the second clutch member with the outer linkage member, so as to have the outer linkage member to drive the assembly body to withdraw the latch for unlocking. The structural design of the clutch mechanism of the present invention is very simple, which also simplifies the overall structure of the lock.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

Figure 1:
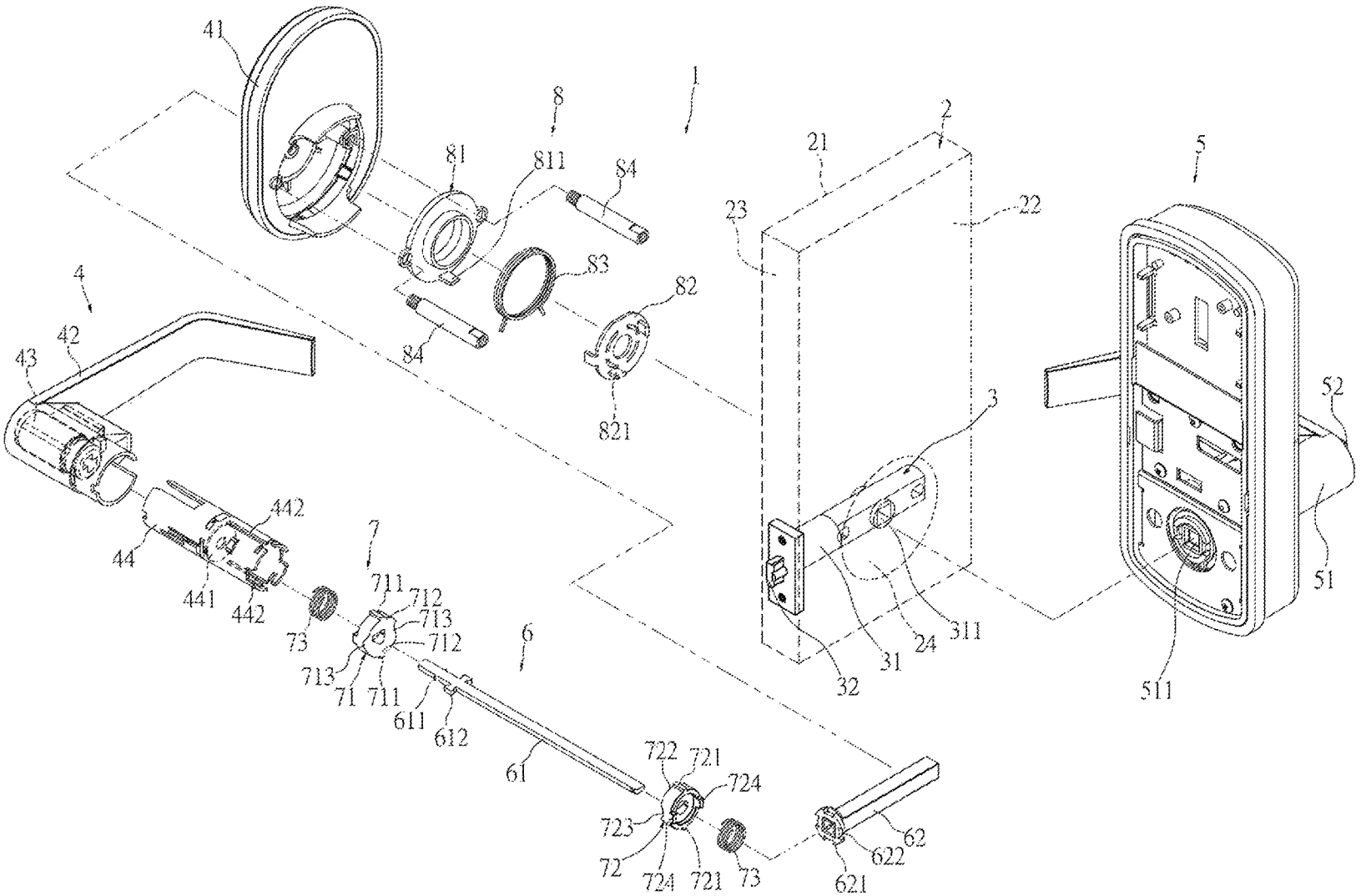
FIG. 1 is an exploded perspective view of a lock according to a preferred embodiment of the present invention and a door sheet.
Figure 2:
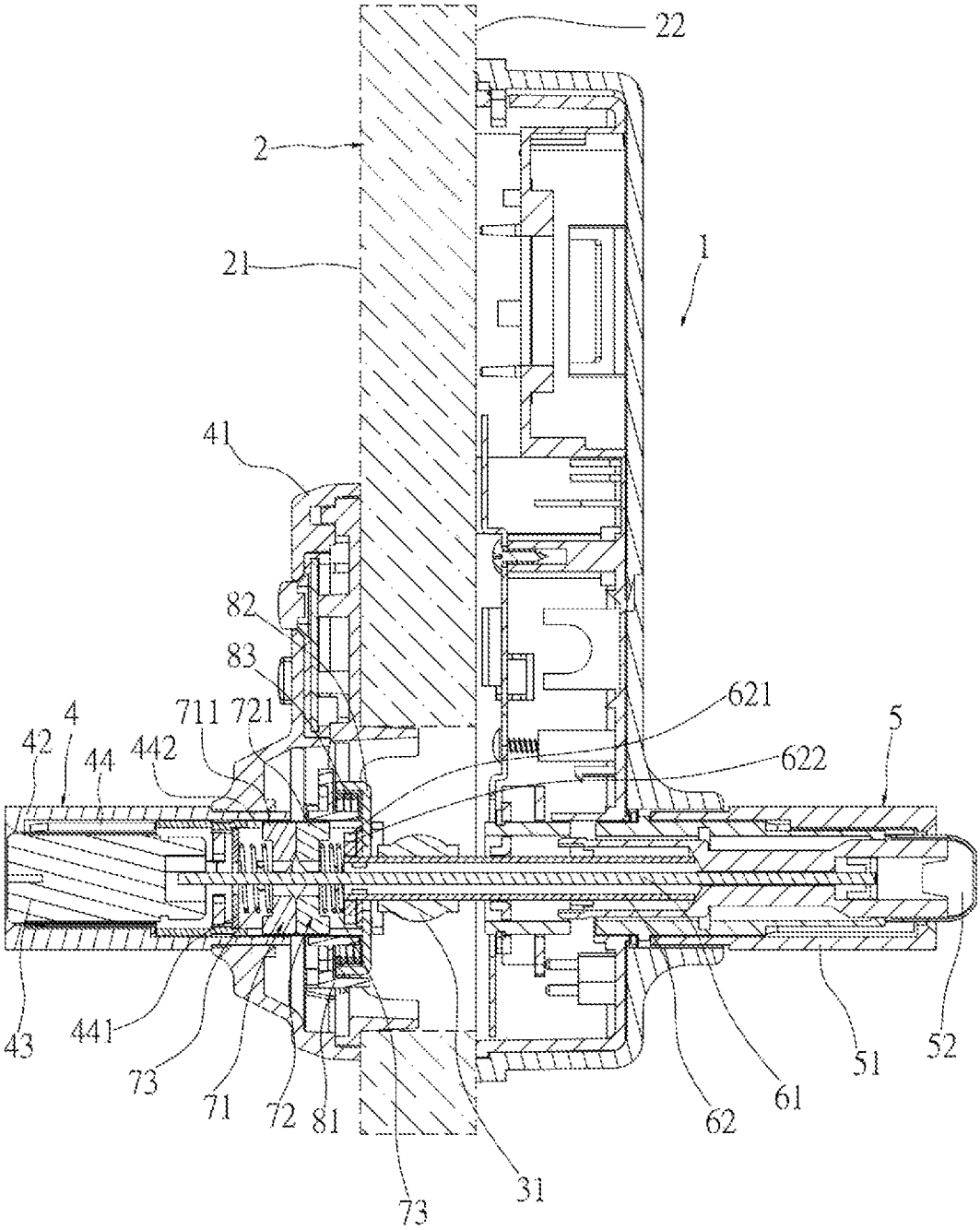
FIG. 2 is a sectional view of the lock according to the above preferred embodiment of the present invention and a door sheet.

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Referring to FIGS. 1-4, a lock 1, according to a preferred embodiment of the present invention, is adapted for being assembled on a door sheet 2, wherein the door sheet 2 has a first surface 21, a second surface 22, a lateral margin 23, as well as an assembling hole 24 passing through the first surface 21 and the second surface 22, wherein the lock 1 comprises a latch assembly 3, a first locking mechanism 4, a second locking mechanism 5, a linkage mechanism 6, a clutch mechanism 7, and a rebounding mechanism 8.

The latch assembly 3 is adapted for being assembled on the lateral margin 23 of the door sheet 2 and extended into the assembling hole 24, and comprises an assembly body 31 and a latch 32 linkably arranged with the assembly body 31, wherein the assembly body 31 has a core lock hole 311 formed at the position thereon corresponding to the assembling hole 24.

The first locking mechanism 4 is adapted for being assembled in the assembling hole 24 from the first surface 21 of the door sheet 2, which is the outer side of the door sheet 2 according to the present embodiment, and comprises a veneer 41, adapted for being assembled on the first surface 21, an outside handle 42 pivotally arranged on the veneer 41, a lock core 43 assembled on the outside handle 42, and a shaft tube 44 connected with the outside handle 42 and axially aligned to the lock core 43. The shaft tube 44 has a baffle 441 on a middle portion thereof and has two guide slots 442 respectively axially arranged in the upper side and the lower side thereof.

The second locking mechanism is adapted for being assembled on the second surface 22 of the door sheet 2, which is the inner side of the door sheet 2 according to the present embodiment, and comprises an inside handle 51 and an anti-lock knob 52 arranged on the inside handle 51. The inside handle 51 has a connecting hole 511 arranged therein.

The linkage mechanism 6 is linkingly arranged among the lock core 43, the anti-lock knob 52, and the outside handle 42, and comprises an inner linkage member 61 and an outer linkage member 62. The two ends of the inner linkage member 61 are respectively connected with the lock core 43 and the anti-lock knob 52. The inner linkage member 61 has two retaining portions 611 and two leaning portions 612 protruded at the end thereof close to the lock core 43. The section of the outer linkage member 62 is in a non-circular tubular shape, which is in a square-tube shape according to the present embodiment, and is sleeved on the outer side of the inner linkage member and passes through the core lock hole 311. The inner linkage member 61 passes through the baffle 441 and the retaining portion 611 leans against the baffle 441 so as to prevent the inner linkage member 61 from axially moving toward the lock core 43. The outer linkage member 62 has a buckling portion 621 arranged at an end thereof in an expanding manner, while the other end thereof is inserted into the connecting hole 511. Each of the two sides of the buckling portion 621 has an indentation 622 provided therein.

The clutch mechanism 7 is sleeved on the inner linkage member 61. The clutch mechanism 7 comprises a first clutch member 71, a second clutch member 72, and two resilient members 73. The first clutch member 71 and the second clutch member 72 are positioned in the shaft tube 44 and respectively arranged on the two sides of the leaning portion 612 and have a first guiding key 711 and a second guiding key 721 respectively arranged on the upper portions thereof to be coupled with the guide slot 442 of the shaft tube 44, so as to only allow the first clutch member 71 and the second clutch member 72 to axially move relatively to the shaft tube 44. The end faces of the first clutch member 71 and the second clutch member 72 facing each other respectively have a first bulging portion 712 and a second bulging portion 722 corresponding to each other in an up and down manner and a first recess portion 713 and a second recess portion 723 positioned in the middle portion thereof. The second clutch member 72 further has an engaging rib 724 protruded on each of the two sides thereof to correspondingly engage into the indentations 622 of the buckling portion 621. The first bulging portion 712 and the second bulging portion 722 lean against each other. The first recess portion 713 and the second recess portion 723 jointly define an accommodation space 74 for accommodating the leaning portions 612. the resilient members 73 are respectively arranged between the baffle 441 of the shaft tube 44 and the first clutch member 71 to push thereagainst and between the second clutch member 72 and the buckling portion 621 to push thereagainst, so as to maintain that the first bulging portion 712 of the first clutch member 71 and the second bulging portion 722 of the second clutch member 72 lean against each other.

Figure 4:
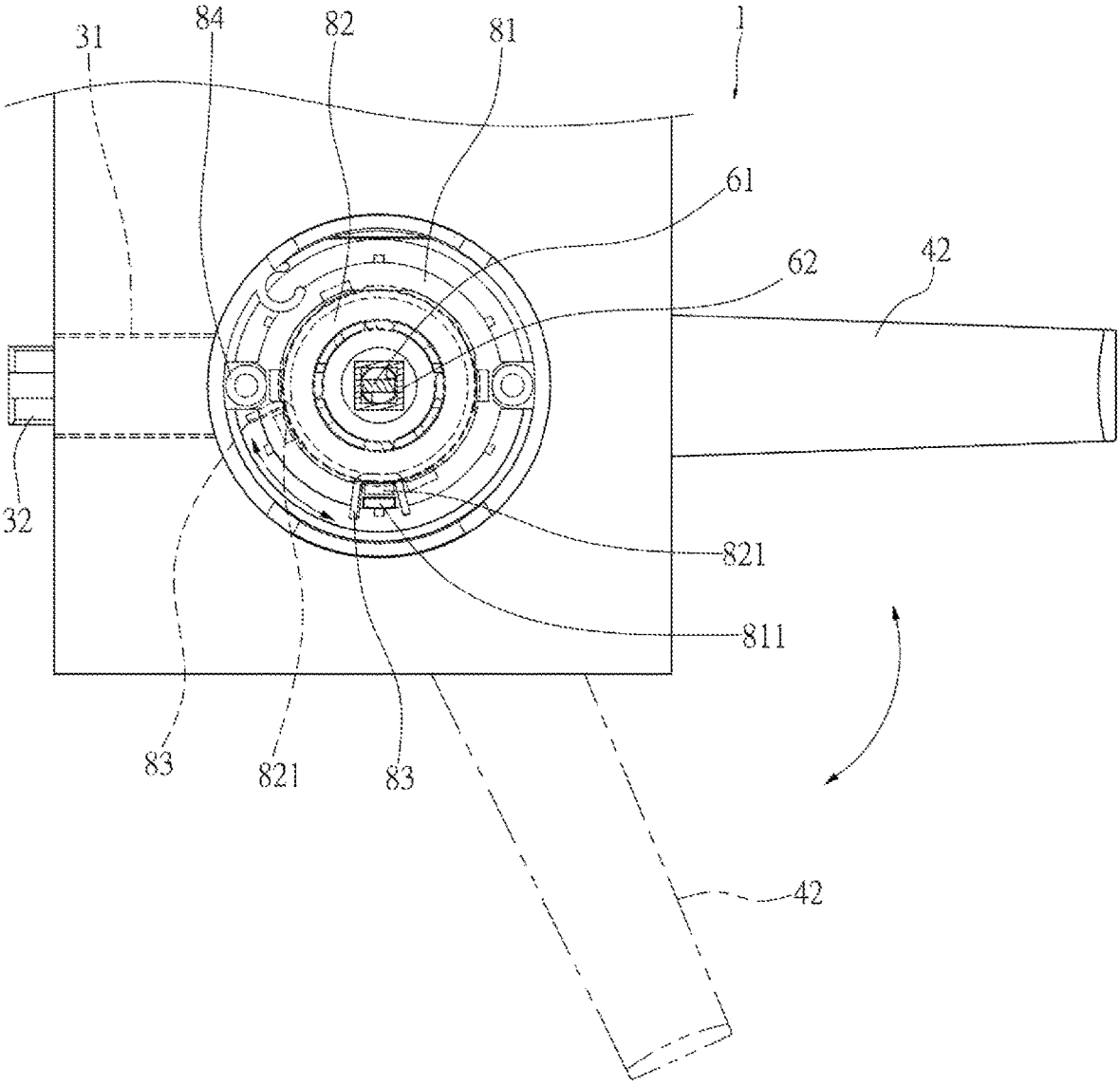
FIG. 4 is a side view of a rebounding mechanism of the lock according to the above preferred embodiment of the present invention.

The rebounding mechanism 8 is assembled between the veneer 41 and the shaft tube 44 and comprises a fixed member 81 affixed on the inner side of the veneer 41, a rotating member 82 assembled on an end of the shaft tube 44, a torsion member 83 arranged between the fixed member 81 and the rotating member 82, and two anchoring members 84. The fixed member 81 has a fixed member wedge 811 protruded thereon. The rotating member 82 has a rotating member wedge 821 protruded thereon. The two ends of the torsion member 83 respectively lean against the fixed member wedge 811 and the rotating member wedge 821. The anchoring member 84 affixes the fixed member 81 on the veneer 41. When the outside handle 42 links and drives the shaft tube 44 to drive the rotating member 82 to rotate relatively to the fixed member 81. The rotating member wedge 821 will bring an end of the torsion member 83 to move along the imaginary line, as illustrated in FIG. 4, and will be stopped and limited by one of the anchoring members 84. At this moment, the torsion member 83 accumulates the torsional force for restoration with the turning movement. By the time the external force acting on the outside handle 42 disappears, the accumulated resilience will bring the shaft tube 44 and the outside handle 42 to restore.

Figure 3:
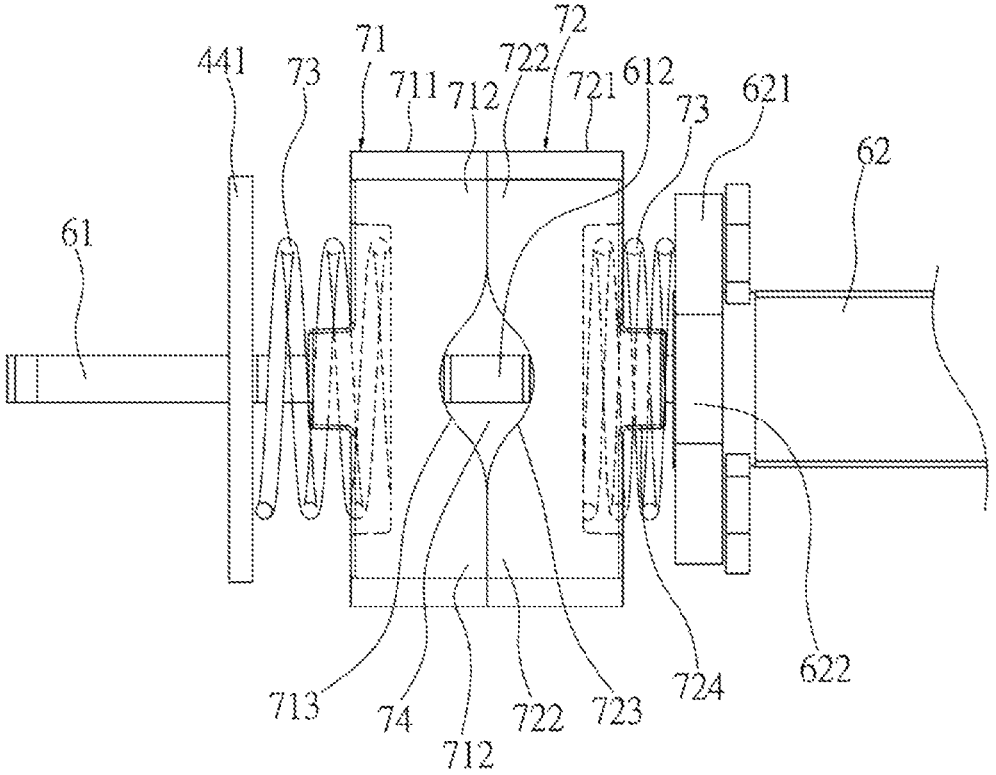
FIG. 3 is a front view of a clutch mechanism of the lock according to the above preferred embodiment of the present invention.

When the lock 1 is locked, the first clutch member 71 and the second clutch member 72 of the clutch mechanism 7 are pushed by the resilient members 73, so that the first bulging portion 712 and the second bulging portion 722 are stay leaning against each other. At this moment, the leaning portion 612 of the inner linkage member 61 is located in the accommodation space 74. If the outside handle 42 is turned, because the engaging rib 724 of the second clutch member 72 has not been engaged into the indentation 622 of the buckling portion 621, as illustrated in FIG. 3, the outer linkage member 62 will not be linked and driven to drive the assembly body 31 to unlock. However, the rebounding mechanism 8 is still linked, which has the rotating member 82 drive an end of the torsion member 83 to move to the position indicated by the imaginary line, as illustrated in FIG. 4, to lean against the anchoring member 84. Therefore, when the external force acting on the outside handle 42 disappears, the accumulated resilience of the torsion member 83 will restore the outside handle 42. Such design that grants the outside handle 42 a rotational cushioning property also prevents the lock 1 from being damaged by instant external force.

Figure 5:
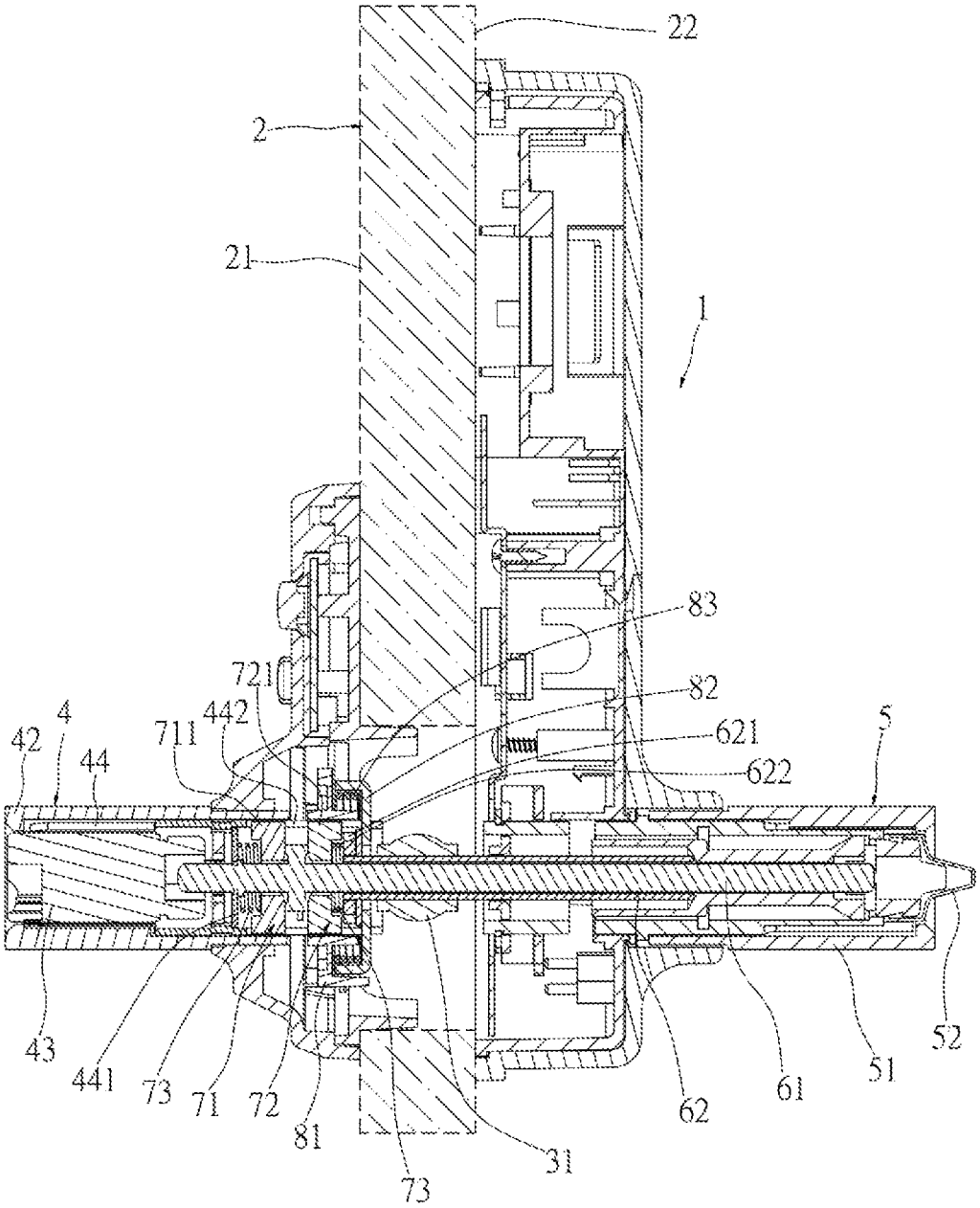
FIG. 5 is a sectional view of the lock in an unlocked state according to the above preferred embodiment of the present invention.
Figure 6:
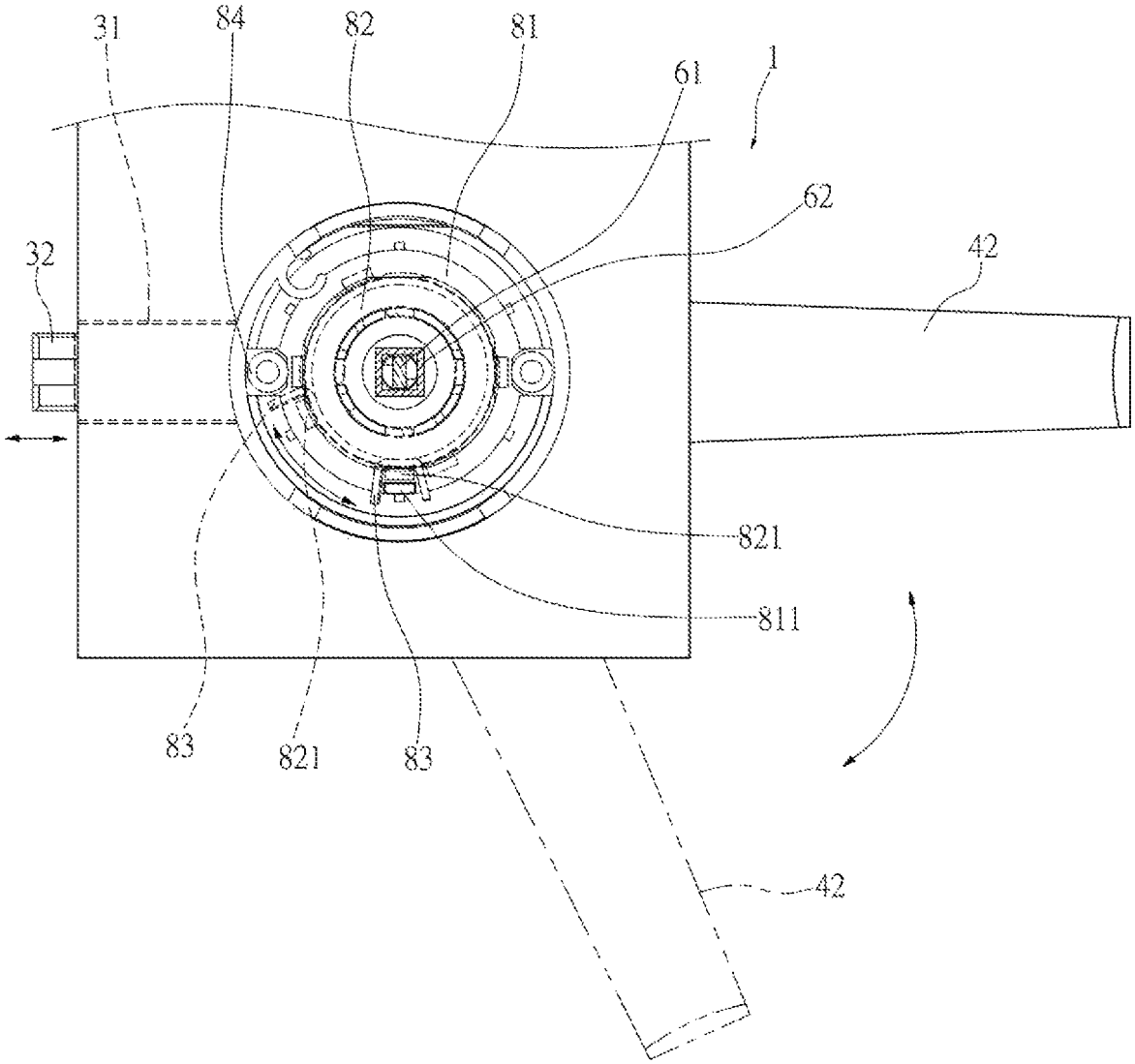
FIG. 6 is a schematic view of the rebounding mechanism of the lock in an unlocked state according to the above preferred embodiment of the present invention.
Figure 7:
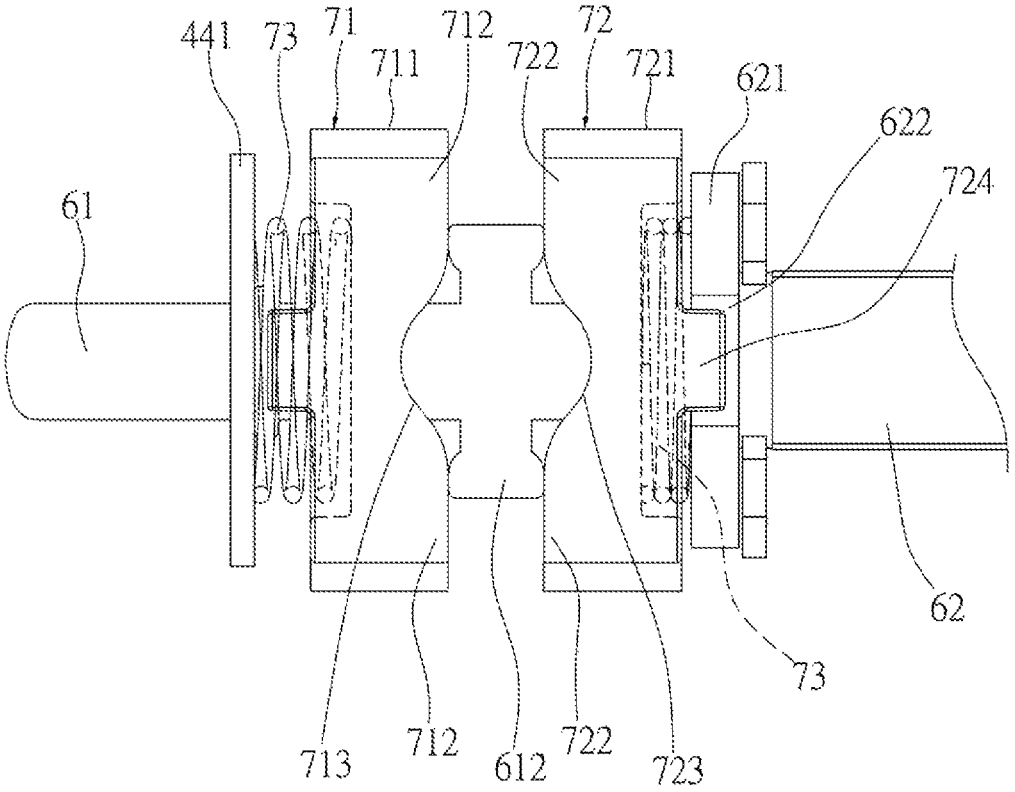
FIG. 7 is a front view of the actuated clutch mechanism of the lock according to the above preferred embodiment of the present invention.

Referring to FIG. 5, when the lock is to be unlocked, the key (not shown in the figures) can be utilized to turn the lock core 43 or rotate the anti-lock knob 52 so as to turn the inner linkage member 61 to the position, as illustrated in FIG. 6. At this moment, the leaning portion 612 of the inner linkage member 61 is moved to the middle of the first bulging portion 712 and the second bulging portion 722, as illustrated in FIG. 7, to push the first clutch member 71 and the second clutch member 72 to move apart. Besides, the engaging rib 724 of the second clutch member 72 is correspondingly engaged in the indentation 622 of the buckling portion 621. At this moment, the outside handle 42 can be turned so as to link and drive the outer linkage member 62 through the shaft tube 44 and the second clutch member 72 to turn, driving the assembly body 31 to link the latch 32 to withdraw for unlocking. Meanwhile, the rebounding mechanism 8 will also be driven to have the torsion member 83 accumulate resilience and the resilient members 73 will also be pressed by the first clutch member 71 and the second clutch member 72 to accumulates resilience forces.

The lock 1 of the present invention utilizes the arrangement that has the first clutch member 71 and the second clutch member 72 of the clutch mechanism 7 coordinate with the leaning portion 612 of the inner linkage member 61 to rapidly and accurately engage the second clutch member 72 with the outer linkage member 62, so as to have the outer linkage member 62 to drive the assembly body 31 to withdraw the latch 32 for unlocking. In other words, the structural design of the clutch mechanism 7 of the present invention is very simple, which also simplifies the overall structure of the lock 1. As a result, the manufacturing costs of the lock may also be reduced.

It is worth specifically mentioning that the lock 1 according to the present invention is capable of not only coordinating with the lock core 43 for unlocking and locking, but also coordinating with a passcode lock, which allows the lock 1 to have more varieties in types.

What is claimed is:

1. A lock, adapted for being assembled on a door sheet, wherein the door sheet has a first surface, a second surface, a lateral margin, and an assembling hole passing through the first surface and the second surface, wherein said lock comprises:

a latch assembly, adapted for being assembled on the lateral margin of the door sheet and extended into the assembling hole, comprising an assembly body and a latch linkably arranged with said assembly body, wherein said assembly body has a core lock hole formed at a position thereon corresponding to the assembling hole;

a first locking mechanism, adapted for being assembled in the assembling hole from the first surface of the door sheet, comprising a veneer, adapted for being assembled on the first surface, an outside handle pivotally arranged on said veneer, a lock core assembled on said outside handle, and a shaft tube connected with said outside handle and axially aligned to said lock core, wherein said shaft tube has a guide slot axially arranged therein;

a second locking mechanism, adapted for being assembled on the second surface of the door sheet, comprising an inside handle and an anti-lock knob arranged on said inside handle, wherein said inside handle has a connecting hole arranged therein;

a linkage mechanism, which is arranged among said lock core, said anti-lock knob and said outside handle, and comprises an inner linkage member and an outer linkage member, wherein two ends of said inner linkage member are respectively connected with said lock core and said anti-lock knob, wherein said inner linkage member has two leaning portions protruded at one of said two ends thereof and close to said lock core, wherein a section of said outer linkage member is in a non-circular tubular shape, which is sleeved on an outer side of said inner linkage member and passes through said core lock hole, wherein said outer linkage member has a buckling portion arranged at an end thereof, wherein another end thereof is inserted into said connecting hole, wherein said buckling portion has two indentations respectively provided at two sides thereof;

a clutch mechanism, sleeved on said inner linkage member, comprising a first clutch member, a second clutch member and two resilient members, wherein said first clutch member and said second clutch member are positioned in said shaft tube and respectively arranged on two sides of said leaning portion and have a first guiding key and a second guiding key respectively arranged on upper portions thereof to be coupled with said guide slot of said shaft tube, so as to allow said first clutch member and said second clutch member to axially move relatively to said shaft tube, wherein end faces of said first clutch member and said second clutch member facing each other respectively have a first bulging portion and a second bulging portion corresponding to each other in an up and down manner and a first recess portion and a second recess portion positioned in a middle portion thereof, wherein said second clutch member further has an engaging rib protruded on each of two sides thereof to correspondingly engage into said indentations of said buckling portion, wherein said first bulging portion and said second bulging portion lean with each other, wherein said first recess portion and said second recess portion jointly define an accommodation space for accommodating said leaning portions, wherein said resilient members are respectively arranged between said shaft tube and said first clutch member to push thereagainst and between said second clutch member and said buckling portion to push thereagainst, rendering said first clutch member and said second clutch member leaning against each other; and a rebounding mechanism, assembled between said veneer and said shaft tube, such that when said outside handle drives said shaft tube to rotate, said rebounding mechanism accumulates resilience, so that when the external force acting on said outside handle disappears, an accumulated resilience drives said shaft tube and said outside handle to restore, wherein in order for unlocking, said lock core or said anti-lock knob is utilized to drive said inner linkage member to rotate, so as to shift said leaning portion into a between of said first bulging portion and said second bulging portion to push said first bulging portion and said second bulging portion apart from each other, so that said engaging rib of said second clutch member engaged in said respective indentation of said buckling portion drives said outer linkage member to rotate to drive said assembly body to link said latch to unlock.

2. The lock, as recited in claim 1, wherein said shaft tube further has another guide slot provided in a bottom thereof and a baffle on the middle portion thereof, wherein said first guiding key and said second guiding key are respectively arranged on a bottom of said first clutch member and said second clutch member and are both assembled in said guide slot and said another guide slot respectively, wherein inner linkage member further has two retaining portions protruded therefrom, such that when said inner linkage member passes through said baffle, said retaining portion pushes against said baffle to prevent said inner linkage member from moving axially.

3. The lock, as recited in claim 1, wherein said rebounding mechanism has a fixed member affixedly arranged on the inner side of said veneer, a rotating member arranged on an end of said shaft tube, and a torsion member arranged between said fixed member and said rotating member, wherein when said shaft tube drive said rotating member to rotate relatively to the fixed member, said torsion member accumulates torsional force along with the rotation.

4. The lock, as recited in claim 3, wherein said rebounding mechanism further comprises two anchoring members affixing said fixed member on said veneer, wherein said fixed member has a fixed member wedge protruded thereon, wherein said rotating member has a rotating member wedge protruded thereon, wherein two ends of said torsion member are respectively engaged and pushing against said fixed member wedge and said rotating member wedge, wherein when said rotating member rotates, said rotating member wedge drives an end of said torsion member to move and be stopped and limited by one of said anchoring members.

* * * * *